US010508388B1

(12) United States Patent
Kiser et al.

(10) Patent No.: US 10,508,388 B1
(45) Date of Patent: Dec. 17, 2019

(54) YARN MATERIAL WITH A WHITE CENTER

(71) Applicants: Ken Kiser, Allen, TX (US); Heath Colwell, Westlake, OH (US); Darryl Costin, Westlake, OH (US)

(72) Inventors: Ken Kiser, Allen, TX (US); Heath Colwell, Westlake, OH (US); Darryl Costin, Westlake, OH (US)

(73) Assignee: Revolaze, LLC, Westlake, OH (US)

( * ) Notice: Subject to any disclaimer, the term of this patent is extended or adjusted under 35 U.S.C. 154(b) by 0 days.

(21) Appl. No.: 15/947,613

(22) Filed: Apr. 6, 2018

Related U.S. Application Data

(60) Provisional application No. 62/506,584, filed on May 15, 2017, provisional application No. 62/506,580, filed on May 15, 2017, provisional application No. 62/506,578, filed on May 15, 2017.

(51) Int. Cl.
*D06P 1/22* (2006.01)
*D03D 15/00* (2006.01)

(52) U.S. Cl.
CPC ..... *D06P 1/228* (2013.01); *D03D 15/0033* (2013.01); *D10B 2201/02* (2013.01)

(58) Field of Classification Search
CPC ..... D06P 1/228; D06P 1/22; D01B 220/02; D03D 15/00
See application file for complete search history.

(56) References Cited

U.S. PATENT DOCUMENTS

2013/0000057 A1* 1/2013 Schoots ..... D06P 1/22 8/494

OTHER PUBLICATIONS

International Commission on Illumination (No date).*

* cited by examiner

*Primary Examiner* — Eisa B Elhilo
(74) *Attorney, Agent, or Firm* — Law Office of Scott C Harris, Inc

(57) ABSTRACT

Dyeing of yarn to create indigo colored outer ring surrounding a white core. The techniques describe ways to keep the white core.

20 Claims, 10 Drawing Sheets
(9 of 10 Drawing Sheet(s) Filed in Color)

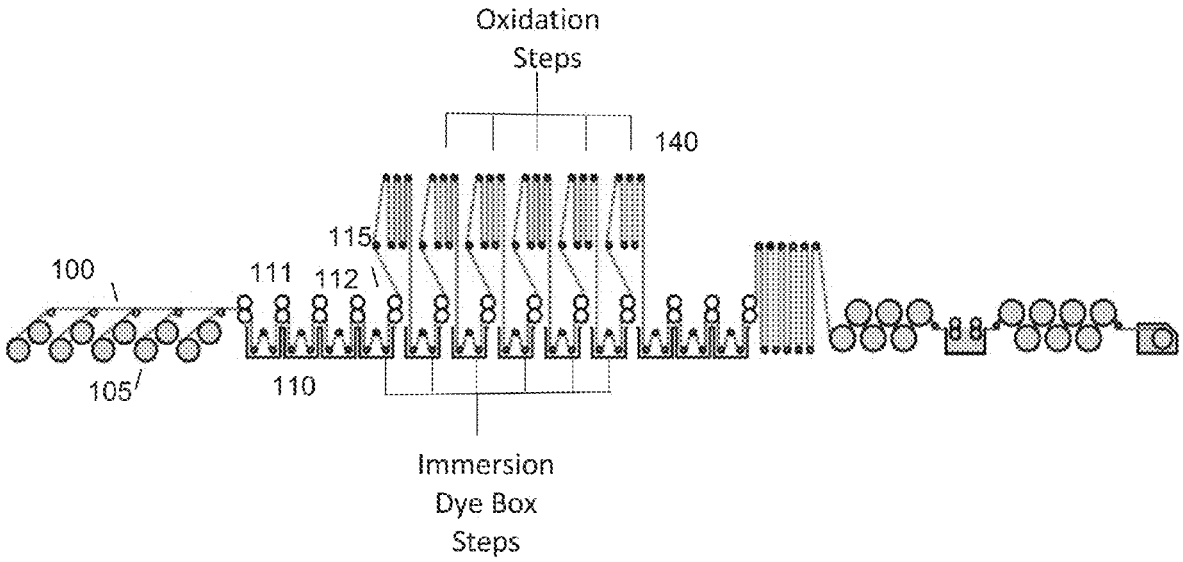
Figure 1. Schematic of Slasher Dye Machine

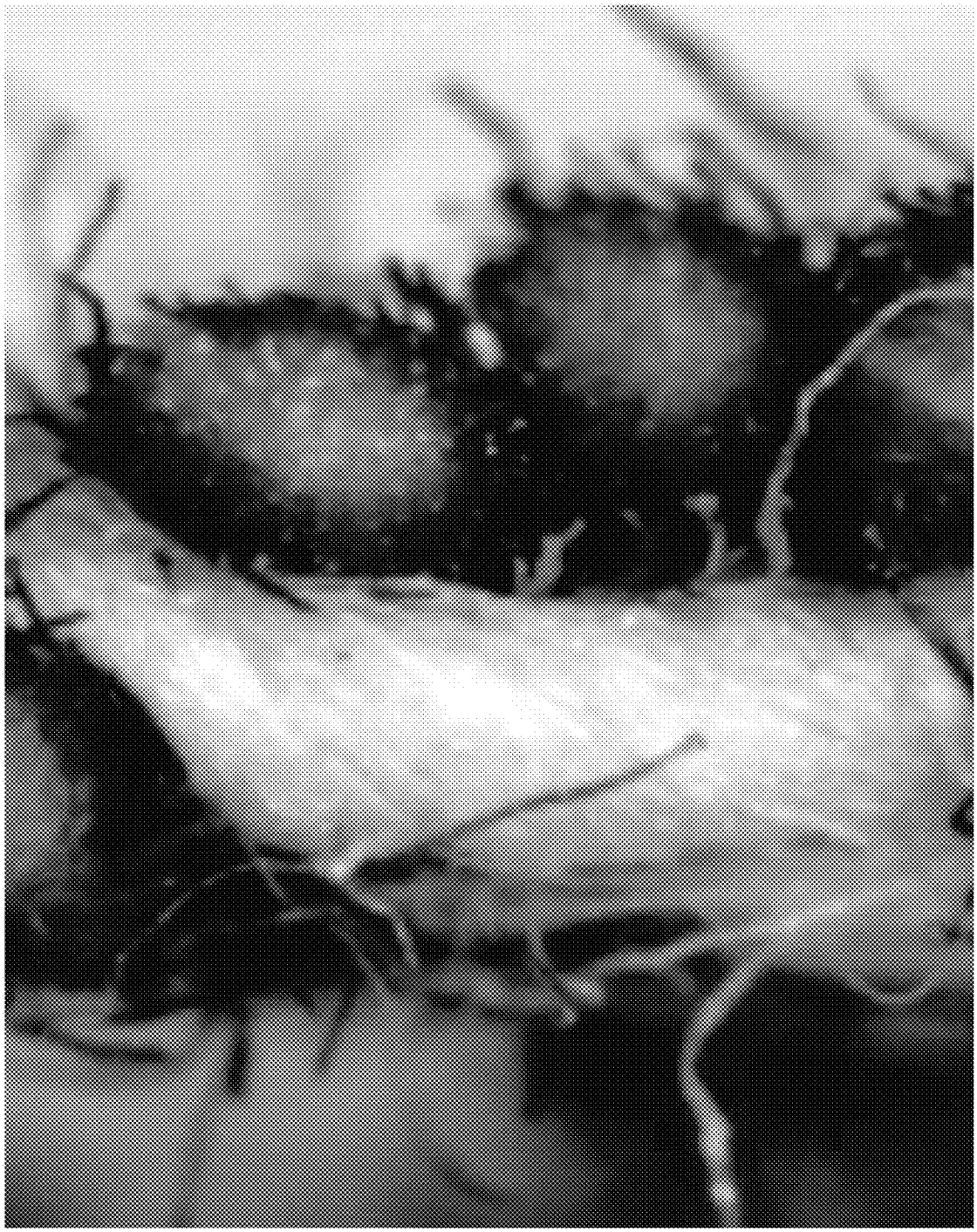
Figure 2. White Core from Example #1

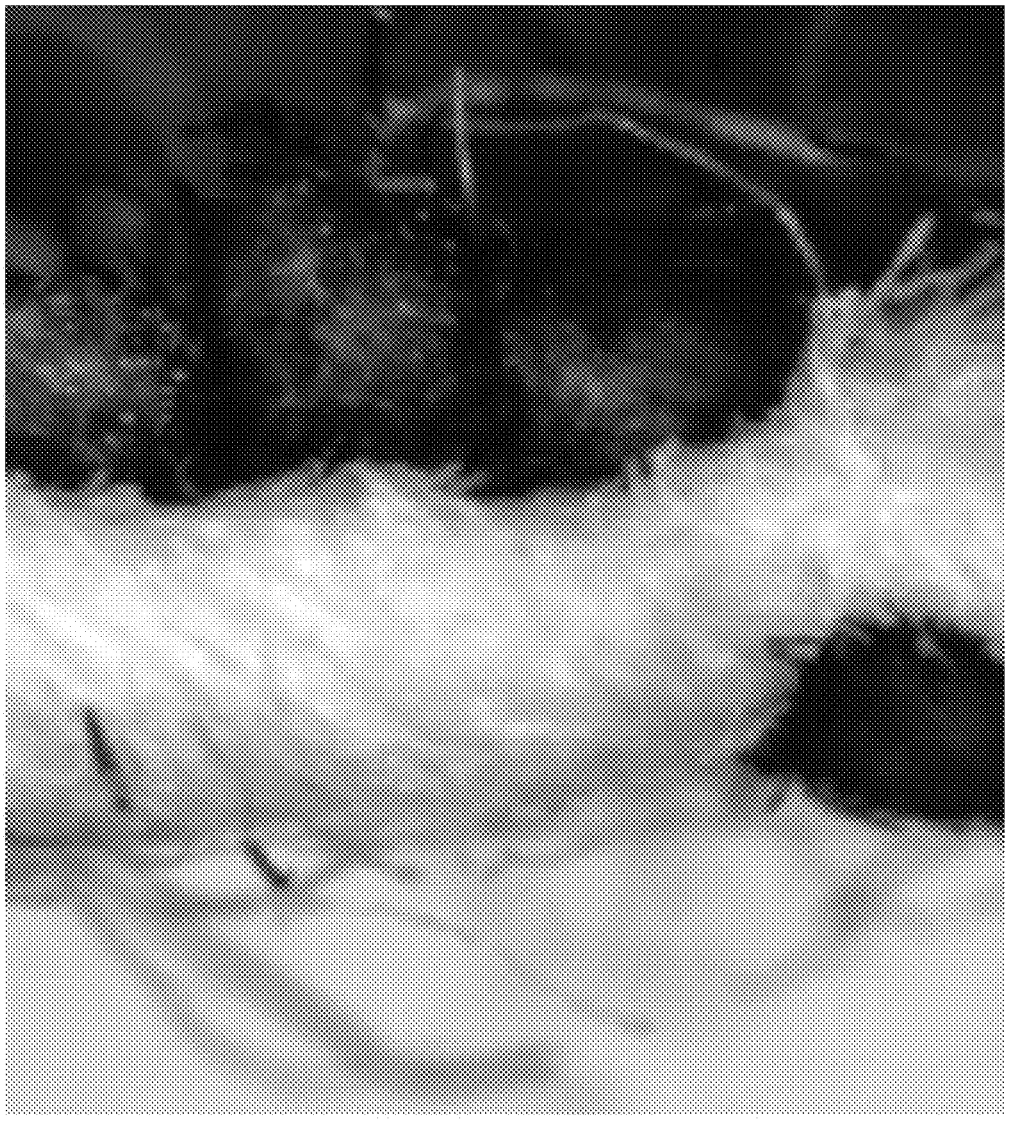
Figure 3 Dyed white core from standard denim fabric

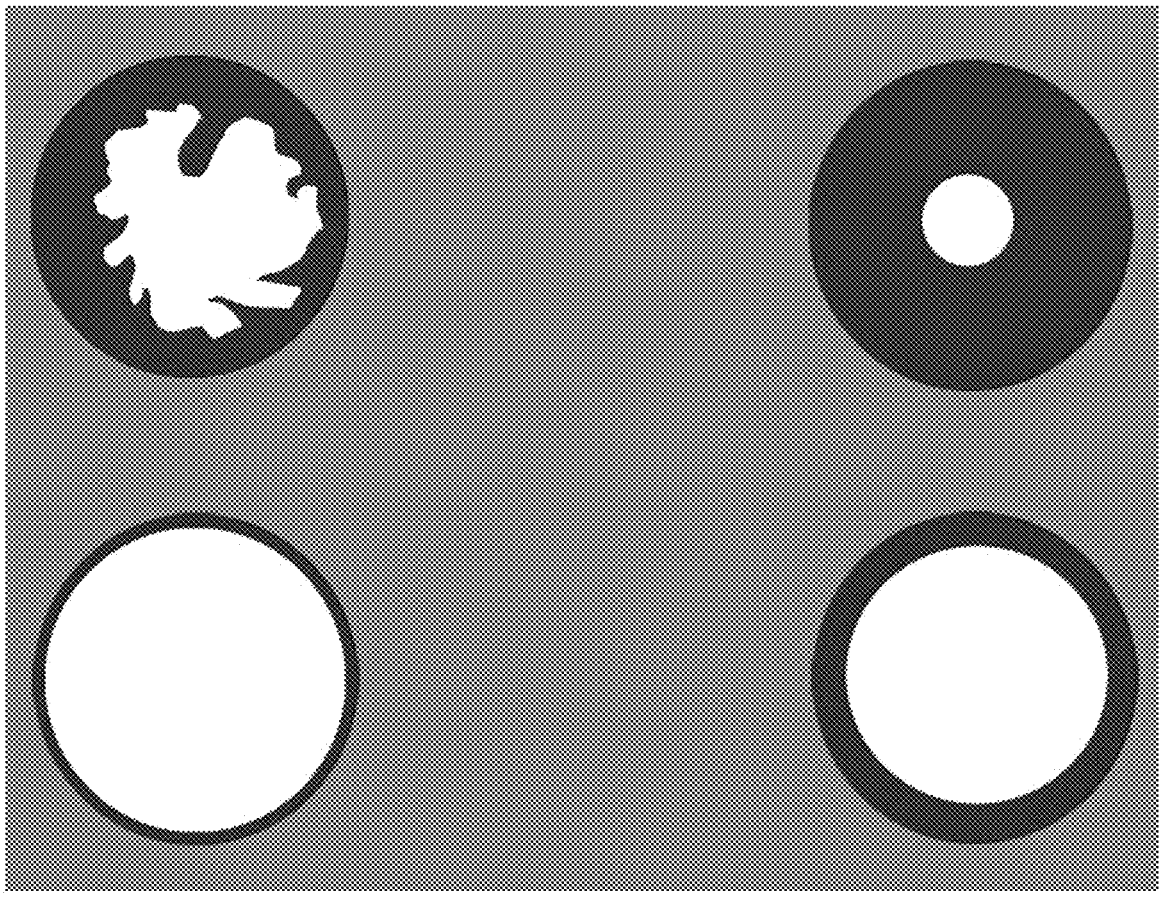
Figure 4. Schematic of Optimized White Core

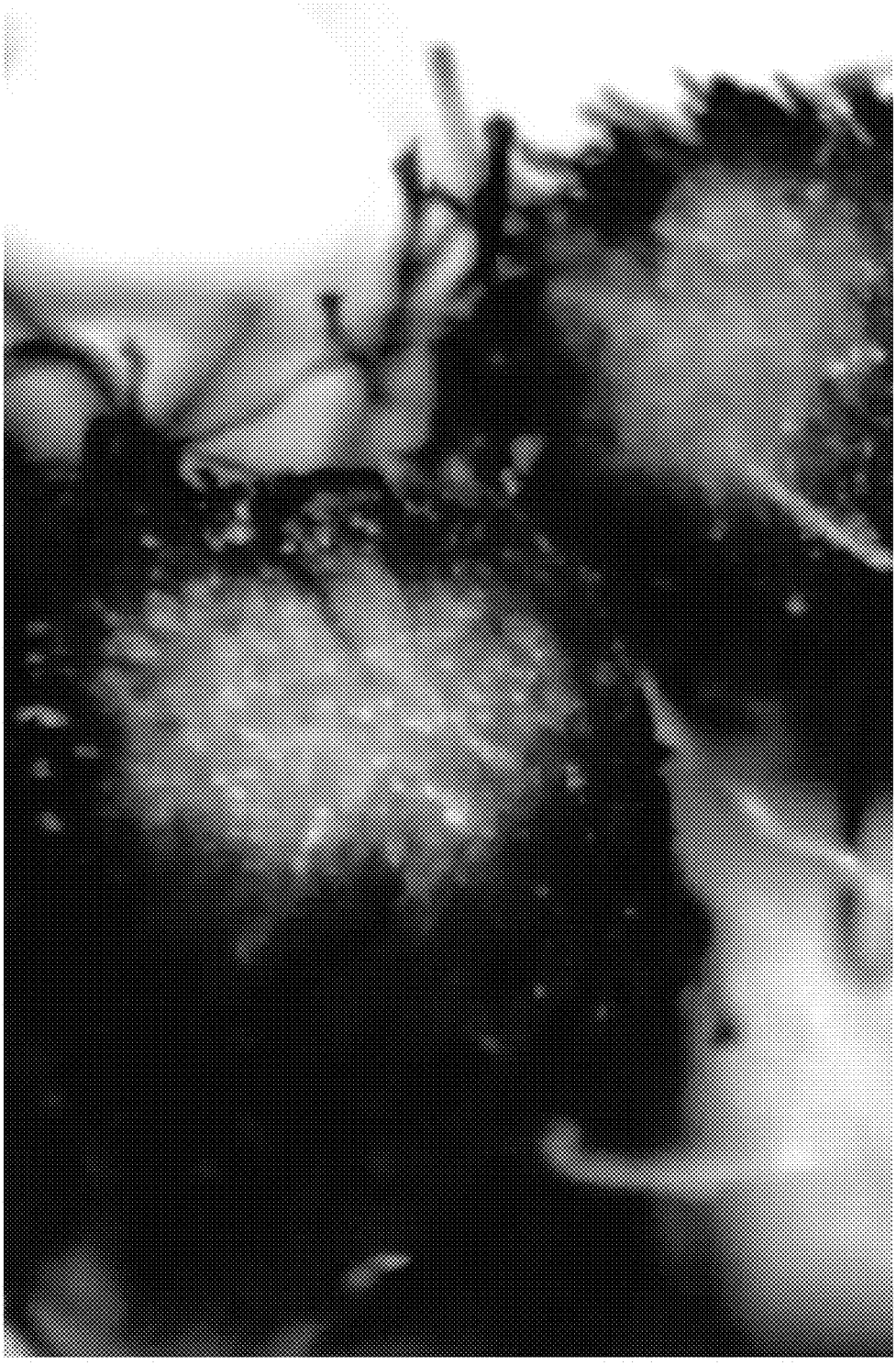
Figure 5. White Core from Example #2

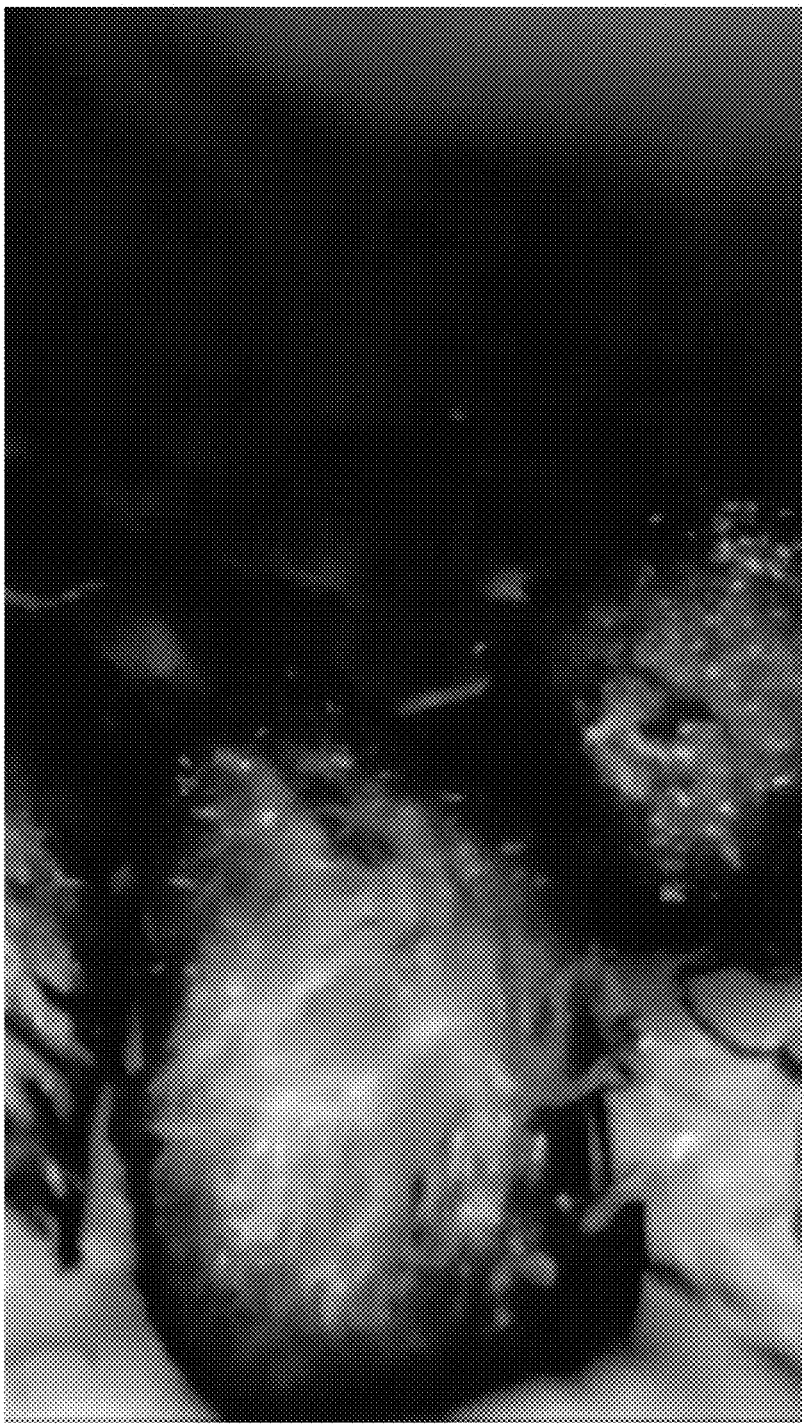
Figure 6. White Core from Example #3

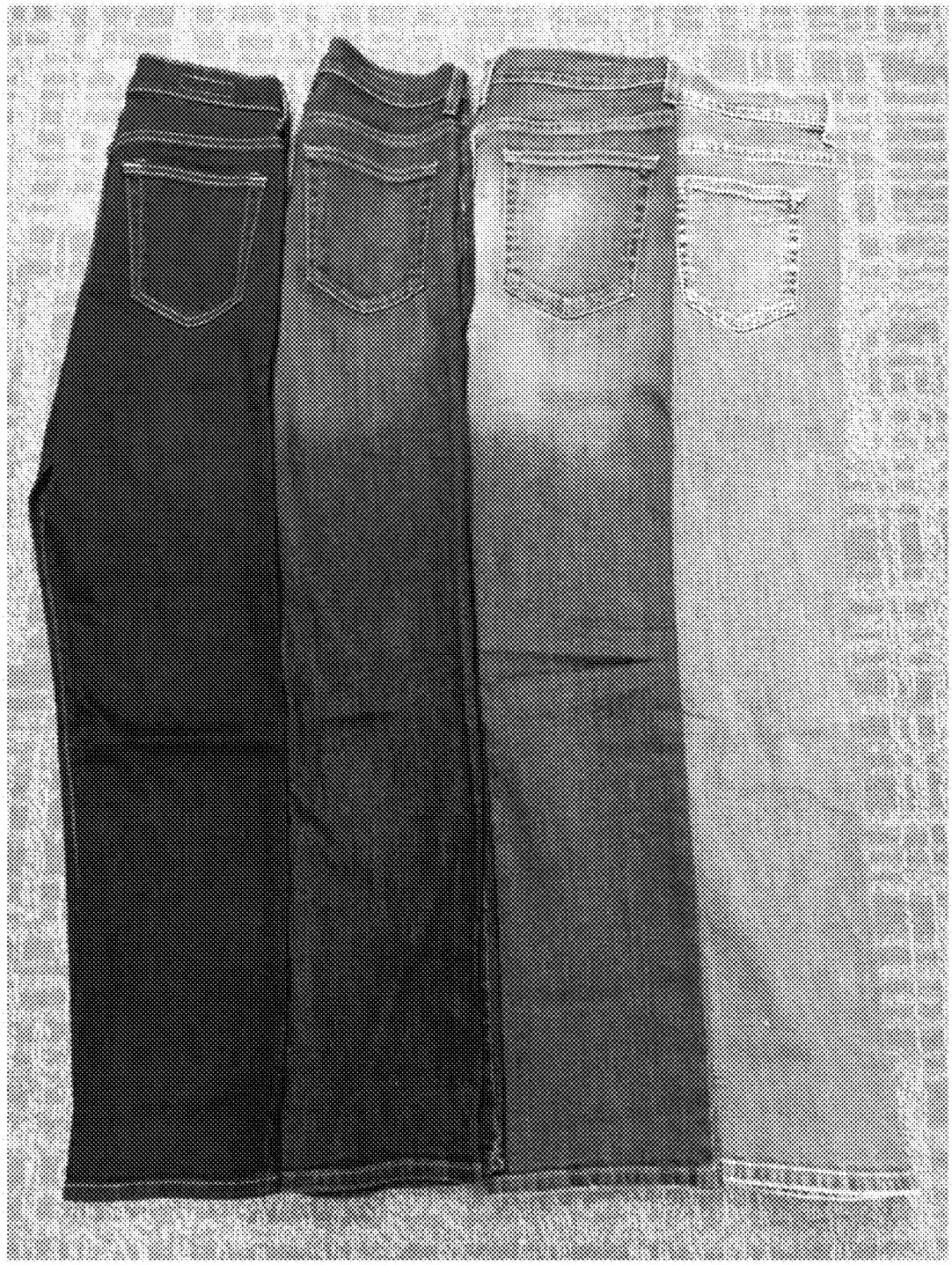
Figure 7. Denim Jeans Produced from Example #1 and Washed

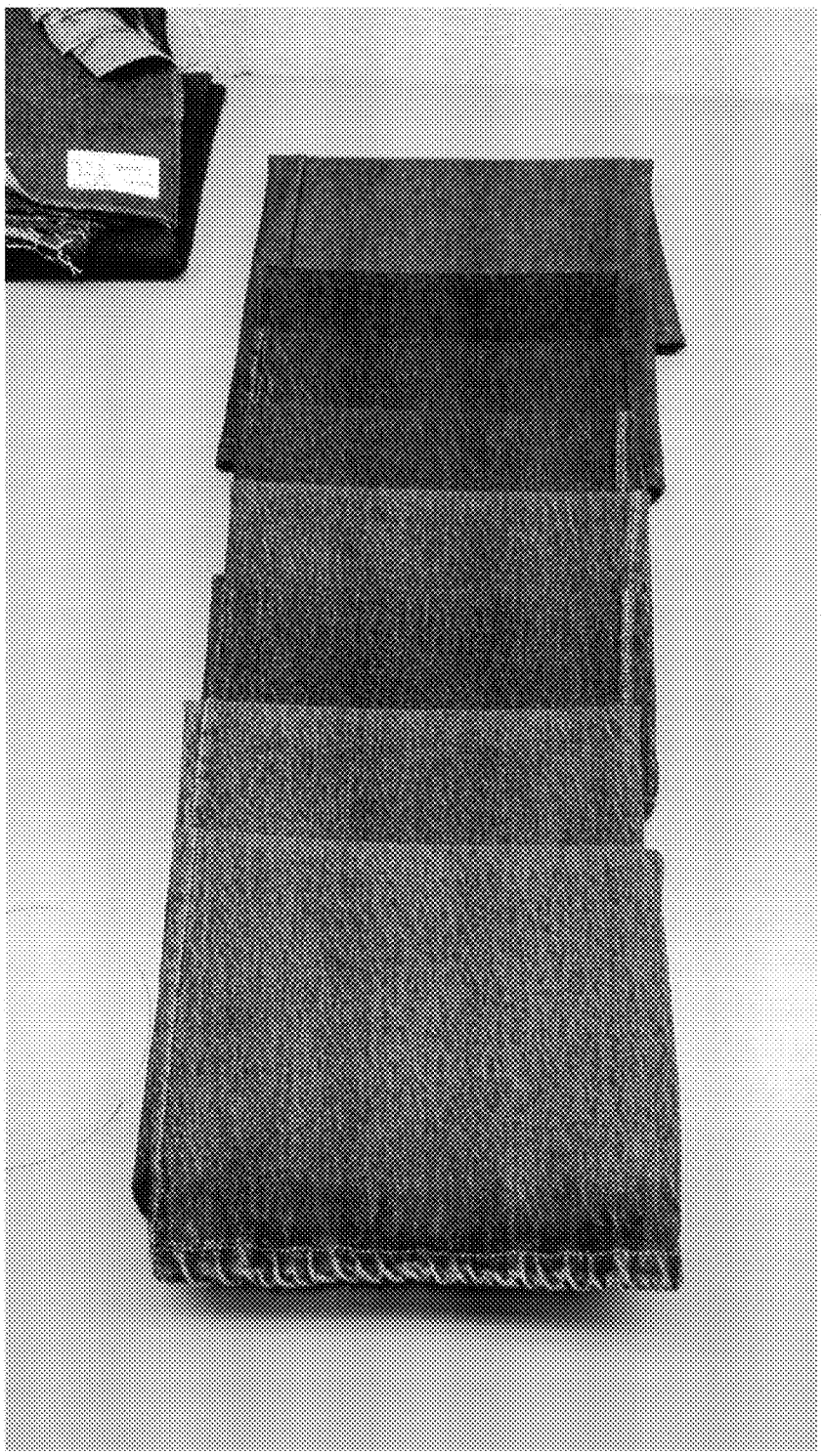
Figure 8. Denim Produced from Example #2 and Washed

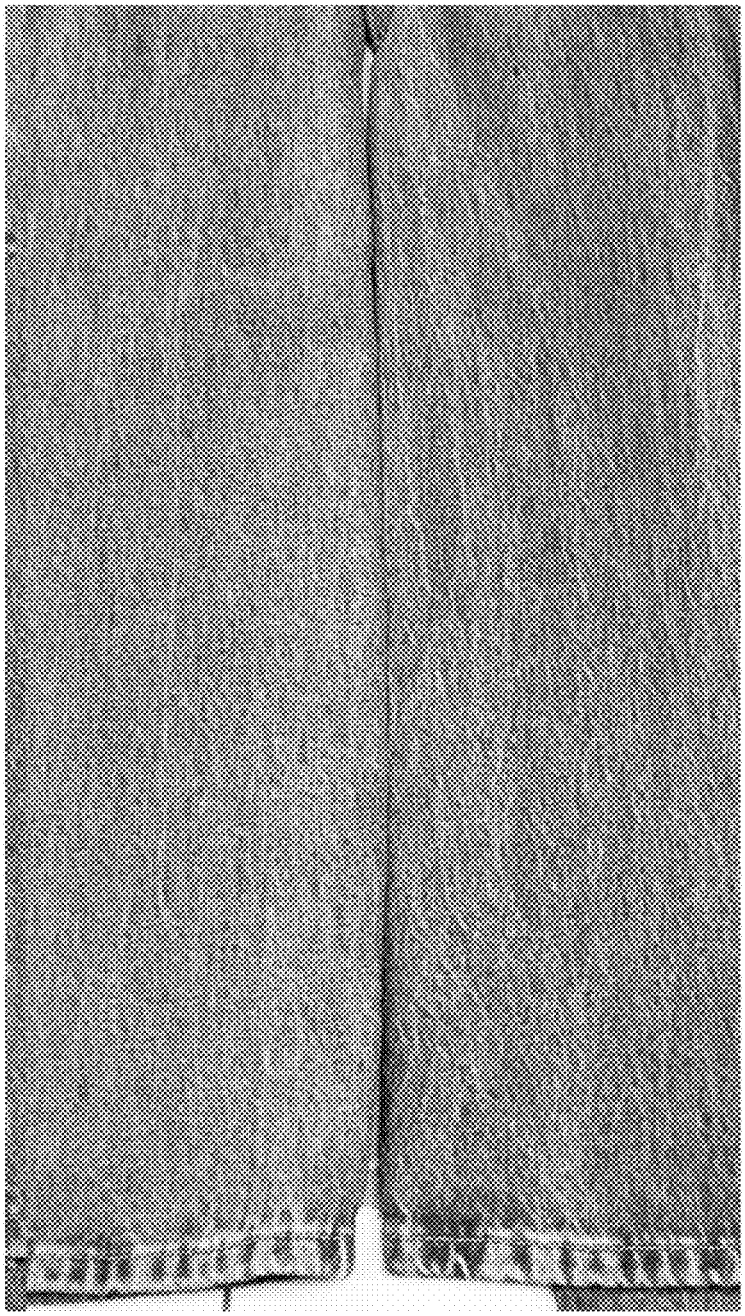
Figure 9. Denim Produced from Example #3 and Washed

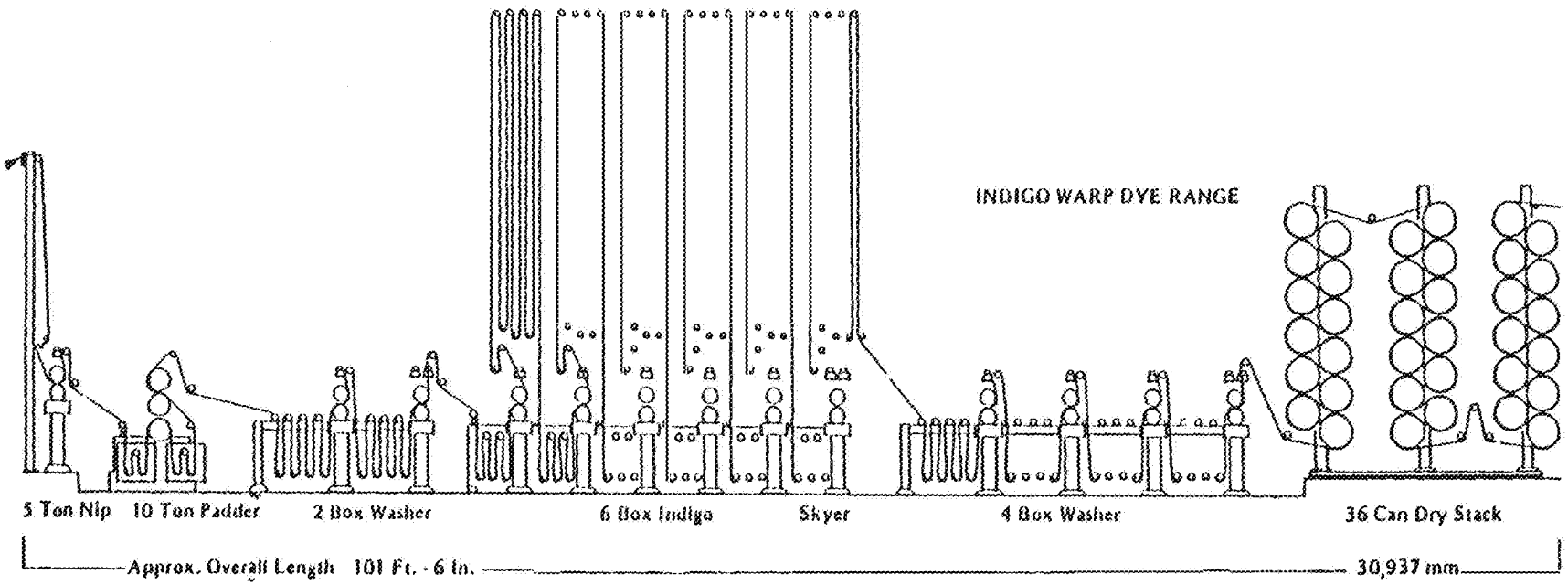
Figure 10. Morrison Textile Machinery Rope Dye Machine

YARN MATERIAL WITH A WHITE CENTER

This application claims priority from U.S. Provisional application No. 62/506,584, filed May 15, 2017, and from U.S. Provisional application No. 62/506,580, filed May 15, 2017; and from 62/506,578 filed May 15, 2017. Each of these provisional applications is incorporated by reference in its entirety.

FIELD OF THE INVENTION

The present invention is directed to improved methods for ring dyeing yarn and processing denim fabric at the denim mill for use in woven fabric and garments. The embodiments result in unexpected but favorable changes in the denim fabric characteristics, that when sewn into garments result in rapid reaction to color reduction methods involving bleach or other oxidizers, as well as stone enzyme washes and thus generate significant savings in water, chemicals, energy and/or most importantly time due to the easier wash down of the fabrics. Even further the embodiments result in water and chemical savings at the denim mill. The fabric produced from this invention can also have novel surface panel effects that duplicate vintage effects and other unique aesthetic effects.

BACKGROUND

Blue jeans are manufactured from denim fabric that contains both weft and warp yarns. The fabric is formed by drawing the weft yarn over-and-under through the lengthwise warp yarns that are held in tension on a frame or loom to create the denim cloth. In the fabric, the warp is the lengthwise or longitudinal thread while the weft is the transverse thread. Denim weft yarns are generally white and the warp yarns are indigo dyed. The yarns could be either ring spun or open ended and the indigo dyeing process can be slasher dye or rope dye processes. Rope dyeing is the most common process. Slasher dyeing is less frequently used and is aimed mostly at higher end or smaller production lots of denim. Rope dyeing makes a bundle of yarn, and dyes the whole bundle at once The dyeing procedure is designed to best apply a ring dyed effect on cotton yarns with indigo, vat, and sulfur dyes. These dye classes require a reduction/oxidation potential (−mV=600 to 800) and high loading of caustic (NaOH, pH approx. 12 to 13) to produce a water dispersible and cotton-substantive dyestuff. The main purpose of ring dyeing is to create a layer of dyestuff on the outside perimeter of the yarn cross section that can be removed when washing steps are performed post dyeing. The stone/enzyme washing creates the desired "salt and pepper" look that retailers and their consumers desire and expect of denim products.

Improved methods for ring dyeing and denim fabric processing would provide a number of advantages. For example, improved ring dyeing would result in a reduction in the use of water, energy, and chemicals in the manufacturing process and even more important a reduction in time to achieve the same wash standard. Further benefits will be the reduced impact on the environment. Furthermore, the delicate balance of variables in traditional dyeing methods are easily disrupted and process improvements can provide improved consistency, reproducibility, and predictability compared to the delicate dyeing processes existing today. Significant benefits in improving the hand sanding or laser abrading process would also be expected. Finally the opportunity to eliminate the use of toxic Potassium Permanganate by achieving the enhanced abrasion typically achieved from Potassium Permanganate but without the use of Potassium Permanganate and with the use of a stone/enzyme/bleach wash.

In a conventional slasher dye or rope dye process, the warp yarn travels through immersion dye boxes as shown in FIGS. 1 and 10, allowing leuco-indigo dye to coat an outer layer of color onto the yarn. This yarn then proceeds into a "skying" or oxidation segment where the soluble leuco-indigo is transformed to the insoluble oxidized blue indigo after exposure to oxygen. The process repeats to continue to build color yield on the perimeter of the yarn.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 1 shows a diagrams of a conventional slasher continuous dyeing machine in which the oxidation and immersion dye box steps are labeled.

FIG. 2 is a microscopic photograph of a denim fabric with a white core of the warp yarn generated from Example #1 from this invention.

FIG. 3 is a microscopic photograph of a conventional denim fabric with a white core of the warp yarn.

FIG. 4 is a schematic of an optimized white core of a warp yarn.

FIG. 5 is a microscopic photograph of a denim fabric with a white core of the warp yarn generated from Example #2 from this invention FIG. 6 is a microscopic photograph of a denim fabric with a white core of the warp yarn generated from Example #3 from this invention FIG. 7 is a photograph of the washed denim fabric from Example #1

FIG. 8 is a photograph of the washed denim fabric from Example #2

FIG. 9 is a photograph of the washed denim fabric from Example #3

FIG. 10 shows a diagram of a conventional rope dyeing range

DETAILED DESCRIPTION OF THE INVENTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

Conventional Ring-Dyeing Methods and Denim Mill Processing Parameters

Traditionally, denim is formed a special weave known as a woven twill. A twill has pattern of diagonal parallel ribs. This pattern is formed by passing the weft thread over one or more warp threads, then under two or more warp threads to form a step or offset, between rows to create the characteristic diagonal pattern of a twill. Denim, typically, is unique relative to other twills in that the warp yarns are dyed blue, where the weft yarns retain their original white color. The weaving process, paired with these contrasting colors, creates a visually appealing textile with seemingly vertical and diagonal lines alternating with white and blue.

The warp yarns used in the denim are typically spun white cotton with layers of dye added to them. This layering of dye on top of the white yarns, when paired with stone/enzyme washing, creates a unique, sought after "salt and pepper" characteristic when the dye is partially removed in areas exposing the white core in neighboring areas still covered in blue indigo. Further, hand sanding or laser abrasion can be applied to the garment before washing to create lighter areas replicating the "worn look". Thus, for example, blue-dyed warp yarns wash down to an attractive lighter blue. This natural "salt and pepper" effect happens with denim fabric produced with warp yarns that have ring effect dyeing (i.e., perimeter dyeing). The greater the dye penetration, the greater amount of abrasion or washing required to lighten or remove color to the white core.

In general, "ring dyeing" refers to a lack of full penetration of dye all the way to the core of the yarn. Therefore, when the yarn is viewed in cross-section a ring-like appearance of the dye can be viewed surrounding a white core as shown in FIG. 3. Typically, this ring-like appearance is very jagged and non-circular, and dye partially penetrates into the core. The dyed warp yarns are then woven with the un-dyed yarns, which are also called filling yarns (or weft). As stated above, when stone/enzyme washed, the white core becomes exposed and results in the "salt and pepper" appearance. Hand sanding or laser treatment is used to remove color so as to create a "worn look" appearance when the blue dye is lighten to white or lighter blue areas. Ring dyeing is typically performed using rope dyeing or slasher dyeing methods. Rope dyeing is described in U.S. Pat. No. 7,201,780. Yarn is gathered in "ropes", typically made of 300 to 400 yarns. These ropes (typically 25 to 50 ropes/machine) are sent through a continuous rope dyeing machine made up of one circulating dye bath separated by a number of boxes as shown in FIG. 10. The ropes travel through the dye baths for approximately 15 to 20 seconds submerged, allowing soluble leuco-indigo dye to coat an outer layer of color onto the yarn. This yarn then proceeds into a "skying" segment where the soluble leuco-indigo is oxidized rendering it insoluble, adhering the indigo to the cotton yarns by its exposure to air, to create the oxidized blue indigo. The process repeats with successive dye exposure to continue to build color yield on the perimeter of the yarn. Dye penetration depths be also controlled with manipulation of the textile auxiliary chemicals in the bath (e.g., caustic (NaOH) or a reducing agent such as sodium hydrosulfite or a sodium borohydride/bisulfite combination. Although there are several critical steps in ring dying and denim mill processing, the inventors believe that the ratio of the time the warp yarn spends in the immersion box to the time the warp yarn spends in the oxidation segment is one critical factor to achieving different and improved denim fabric characteristics and properties.

A slasher continuous dyeing machine as shown in FIG. 1 uses the same dyeing mechanism and process as rope dying but with less yarn. Only the amount of yarn used in a creel for a loom runs through the machine (3900-4400 individual yarns, 4-5 meters wide). This allows for more accurate creation of specific colors. This process also allows for direct placement of final yarn directly into a loom.

Conventional wisdom within the textile industry have led those of skill in the art to try to significantly reduce the number of dye tanks in order to reduce the dimensions and costs of dyeing ranges, water, and chemicals in dyeing processes (See, e.g., PCT Patent App. Pub. No. WO2006013458; U.S. Pat. Nos. 7,908,894; and 8,215,138). Conventional wisdom has also led those of skill in the art to reduce oxidation time in order to reduce waste at each batch stage The 894 patent speaks to the necessity for a hermetically sealed dye tank, the temperatures of the dye and the impact it has on the corticality [sic] of the dyeing as a result. (See, e.g., PCT Patent App. Pub. No. WO2006013458; U.S. Pat. Nos. 7,908,894; and 8,215,138). Typically, conventional dyeing methods use a ratio of immersion time to oxidation of 1:5.

Characteristics of the denim fabric are determined in a large part by this ratio as well as other key indigo dyeing variables and denim mill processing parameters. These ratios have been accepted throughout the industry as submersion/oxidation ratios, and have been unquestioned and adopted by every machine builder within the industry. Relatively slight modifications are only possible on known machines through changes in speed in which the range is operated which means in order to increase oxidation times, machines currently have to process their material at a lower throughput.

Improved Ring-Dyeing Methods and Denim Mill Processing Parameters

The present invention is directed to improved methods for perimeter dyeing/ring dyeing yarn for use in woven fabric for rapid reaction to mechanical or chemical washes, including enzyme washes, stone washes, oxidizing processes such as bleaching agents or ozone, and laser washes and also describes an improved yarn material. The disclosed methods are geared to optimizing the process of achieving a range of blue outer perimeter with excellent fastness characteristics, and the retention of a circular white core of a 100% cotton, cotton/spandex, cotton/Tencel/spandex, or cotton/polyester/spandex warp yarn that is vat-dyed (utilizing pure indigo or indigo and sulfur dyestuff additive layers) by inhibiting dye penetration beyond a certain level. This is achieved through a series of interrelated production steps, which the inventors believe are dependent on one another for success. For example, it is entirely conceivable that dye could penetrate to the polluted core, but the reduced fastness would make it much faster to release the dye upon washing, yet but before washing it could appear dyed or partially dyed.

An example is given while describing actions taken by the company Romatex, employees of which are an inventor of this application, in finding these parameters. For decades, Romatex production consisted entirely of shirting material. For their shirting process, a slasher dye range was used. As the sourcing for shirting moved to Asia, Romatex converted their product line from shirting to denim. The competing denim yarn dyeing process typically involves a rope dye range which is significantly faster. This production speed difference had a direct impact on cost, which inspired a search for increased productivity while still minimizing costs.

First, the speed of the range was simply increased. Where manufacturing was being done at 8.5 m/s, their goal was 20 m/s. The speed of the motors were increased to 18 m/s simply enough, but after doing so it was apparent that their immersion/oxidation ratio of about 1:5 was insufficient with the increased speed. Oxidation occurs after being dipped into leuco-indigo by means of a dye immersion tank, and then proceed to a series of reels that are a given distance apart which simply expose the yarns to air/oxygen which allows the indigo to return to an insoluble state, fixing it to the cotton. After coming to this realization, their dye range was modified such that they raised their top reels, nearly doubling their original height from the bottom reels, presumably with the idea that if their process were to double in speed, then a proportional increase in height should retain their ratio at the higher speed. The result was an immersion to oxidation ratio that far exceeded the needs of typical manufacturing scenarios at approximately 1:10, e.g., between 1:6 and 1:18, with a throughput of 18 m/s. The increased oxidation time does not have a negative impact on throughput. However, they soon realized something must be different when new characteristics of their denim goods appeared to result in easier wash down of the garments made from their denim fabric. Perhaps they surmised that although the long oxidation ratio (1:10 immersion to oxidation) was against conventional wisdom and the conventional standard, there may be an advantage that was never before realized.

While 18 m/s was a substantial increase in line speed which went great lengths to close the competitive gap with rope ranges, rope ranges still had a yield advantage with their 25-30 m/s line speed. To further close the gap, Romatex sought to source chemicals that would achieve similar results with reduced costs, even if it resulted in higher handling costs as labor is relatively low cost per yard. One such cost saving measure was the usage of indigo powder or "cakes", as opposed to the industry standard premixed leuco-indigo dye solution. Indigo dye is ideal for clothing because it is not naturally water soluble. This results in a garment that largely remains a similar color when exposed to standard washing, as the water alone used during the washing has little impact on the dye fastness. In order to successfully dye garments, indigo is mixed with chemicals such as $Na_2CO_3$ (soda ash) to increase the alkalinity, making the indigo into a water soluble form known as leuco-indogotin. Doing this process themselves by choosing the lesser expensive indigo cakes, Romatex deviated from the norm, using enough soda ash to make the indigo water soluble, but with a lower pH (10.8-12) than the industry typically sees (about 12.5) in addition to being able to modify their viscosity which is an embodiment. Conventional wisdom tells dyers to use pre-reduced pastes (20% or 40% active solids) at high concentrations (3.0-5.0 g/L) since it is easier to handle and can promote dye penetration in the warp yarn. Romatex's approach is to use powdered indigo, which is more stable with less variation, less base cost, and can achieve deeper shades since it's 100% solid. Importantly, powdered indigo is not fully dispersed in the dye box. Lower temperatures and lack of mixing also contribute and are embodiments.

Romatex uses powdered indigo at much lower concentration (1.0-3.0 g/L), a critical embodiment, since it is 100% active. This still translates to much higher indigo by weight on yarn surfaces compared to pastes. The lack of full indigo mixing leaves larger particle sizes that, the inventors believe, cannot penetrate into warp yarn interiors. Normal indigo pastes are only 20% active, which means that 80% is excess caustic having sodium hydrosulfite that is very harmful to machinery and the environment. Romatex balances dye box chemistry to use less amounts of caustic and sodium hydrosulfite, which is less to treat in the wastewater system.

At competing facilities, the dye tanks are often heated, which open the yarns and make them more readily receive the dye. Ordinarily this would be critical because in order to achieve the dark colors that are in demand, greater yarn penetration applied more indigo which increased the amount of indigo available for oxidation in the standard 1:5 ratio the balance of the industry uses. In an effort to save these fuel costs, the dye tanks at Romatex are maintained at room temperature which is yet another embodiment. Operating at lower temperatures meant that their yarns were not opening up, and were increasingly resistant to dye penetration, particularly so with their oily/waxy core from a difference in scouring.

Before applying any dye at a mill, the yarns are cleansed, or "scoured" as the industry has coined the process. This is a chemical bath that removes dirt, metals, and other containments that were missed in processing from bale to yarns, in addition to oils and waxes present throughout the yarn that make the yarn resistant to dye penetration. Usually, these scouring processes try to scour all the way to the core of the material, and reach at least 75% of the way to the core. In a cost saving measure, Romatex sourced a less expensive scouring agent, not realizing that the concentration of the agent dropped by up to 80%. What this meant was that the waxes and oils were only removed from the outside perimeter of the yarns, e.g., only from the outside 20% of the yarn, leaving the center more resistant to dye penetration, and much more resistant to dye fastness with any indigo that may have reached the core. Ordinarily this would result in very lightly dyed yarns, as too little indigo was available for oxidation in the time allotted in the typical ratio. However with the exponential increase of oxidation time (nominal 1:10 ratio of immersion to oxidation) at Romatex, the ring of indigo dye on this reduced area had increased time and consequently increased exposure to oxygen. This exposure to oxygen heightened the fastness of the dye that was present.

The conventional process is to completely scour the raw cotton warp yarns with harsh chemicals at high temperatures (80-90 C) to remove all natural oils, waxes, and motes lends the yarns to more dye penetration. Romatex instead scoured cotton warps partially to expand cotton into a circular shape (as opposed to a lumen "kidney" shape), fix natural impurities deeper into the surface, and clean only the outer yarn surface. Romatex's method actually uses less caustic and detergents, which saves cost and is more environmentally friendly due to less chemical usage. Less scour actually makes warp yarns stronger since they are not degraded by harsh chemicals and natural waxes act as glue for short fibers. The lower temperature scour (40-50 C) also prevents both detergent scour and dyes from excess penetration, which saves Romatex energy costs, and is more environmentally friendly. Less detergent wet-out leaves partial cotton spaces (bubbles), waxes, and oils in yarn interior that prevents dyes from migration to center, which reserves the circular space for a nice round cross-section and is an embodiment.

Another embodiment carries out lower temperature scour (70-80 C) with a chemical cocktail of:

1. Sodium hydroxide (50%)---60 g/L
2. Decyl alcohol wetter/penetrant that also acts as detergent---2 g/L, and
3. Chelate/sequestrant---3 g/L The combination of these two operations, the lessening of the scouring, and the non traditional increase in oxidation exposure relative to dipping time along with the reduction of pH and the use of denim powder are believed to be fundamental, critical embodiments. Neither one of these contributions alone may not have such a significant positive effect with regards to white core retention without some of the others. However, there were found some other important factors found, namely increasing the twist multiple (TM) of the warp yarn that results in increased yarn density. Typically the twist multiple of the warp yarn is about 3.0 to 4.5. Trials with much higher twist multiples of 4.4 to 4.6 produced excellent results in reducing dye penetration into the white core and are also critical embodiments. Twist multiple is the industry standard for spun single yarns and is a constant to arrive at the required twists per inch (TPI). The TPI is TM times the square root of English cotton count. Further increasing twist multiples for the weft yarn beyond the industry norm as shown in Table 1 produced excellent results and further gave rise to different denim design aesthetics as discussed below for the "Crunch" and "Crackle" effects.

Several trials and experiments were conducted in order to more fully understand the impact of these and other variables on the white core area and shape and therefore the wash down savings. Some of the results are shown in Table 1 which reveals the major differences from Example #1 and the Standard which is a conventional denim fabric from a leading denim mill. Some of the factors mentioned above play a large role for Example #1 which are the increased warp twist that prevents penetration, powdered indigo that was not fully solubilized, the lowered dye range temperature and the focused pH for limited dye penetration. The major difference in Example #2 compared to Example #1 that further enhanced the circular white core and increased overall savings was the higher warp twist multiple from a range of 3.9 to 4.2 to a range of 4.4 to 4.6. That increase further prevents dye penetration. The higher warp twist multiple prevents both detergent scour and dyes from excess penetration through overall increase in yarn density. In Example #2, the weft yarn twist multiple was also higher and went from a range or 4.4 to 4.6 to a range of 4.9 to 5.1. That increase resulted in a change in aesthetic from a flat look to a "Crunch look". This Crunch look is a vintage denim jean appearance that exhibits subtle vertical panel veining or streaked effects. The major difference in Example #3 compared to Example #2 that even further enhanced the circular white core and further increased savings was the lack of finishing. No wet processing after weaving does not allow water and processing temperatures to drive dyestuffs deeper into the white core which is another embodiment. Six finishing range steps are eliminated, which saves tremendous processing costs, water, energy, and chemicals. Elimination of higher levels of caustic in normal Romatex mercerization step saves chemicals over-loading the wastewater system. Also, the elimination of higher levels of caustic and temperature in normal Romatex mercerization step prevents expansion of cotton core that would allow dyestuff migration towards the white core. The use of durable cornstarch on the dye range provides an additional barrier to any wet penetration. Most importantly, no wet finish maintains consistent white core circular shape instead of jagged cross-sectional effects if fully finished. In Example #3, the weft yarn twist multiple was also higher and went from a range or 4.9 to 5.1 to a range of 5.9 to 6.1. That increase resulted in a change in aesthetic from a "Crunch" look to a "Crackle" look. The Crackle look is a denim surface panel marble appearance. The lack of woven fabric finishing in wet medium was shown to reduce dye penetration and play a major role in the higher percentage of the warp core to be white. In Table 1, the inventor listed Example #1, Example #2 and Example #3 and the percent of white core available along with overall savings. An embodiment is to eliminate some or all of the wet finish into Examples #1 and #2. This would further increase the white core and overall savings, while still keeping the original aesthetics the same. Another embodiment is to adjust the warp and weft yarns in Example #3 to change the aesthetic to more of a flat or "Crunch" look, while still keeping the increased white core and overall savings. The warp and weft yarns would be as high as possible yet similar to keep a more basic aesthetic. Different combinations or changes to the factors can be made in Table 1 to further enhance the white circular core and overall savings by keeping the aesthetic flat, more of a "Crunch" look, more of a "Crackle" look or a new aesthetic.

A summary of the finishing differences among the three examples in Table 1 is shown below, all of which represent embodiments:

1. Example #1
   a. Normal denim mill brushing and flame singe applied to remove loose surface fibers
   b. Hot water rinse (90° C.) for 15 seconds to wet denim fabric for mercerization
   c. Mercerize with heavy caustic concentration (20% active)---steam at 100° C. for 15 seconds to allow caustic to penetrate (20 meters/second)
   d. Two (2) warm water rinses at 80° C. to remove caustic
   e. One rinse at 60° C. with acetic acid to neutralize caustic
   f. One cold water rinses at 30° C. to remove chemical salts
   g. Normal denim skew process applied to control denim torque/twist
   h. Adjust denim width on pin tenter (normally denim pulled one inch wider than introduced)
   i. Normal denim sanforization process applied to control warp shrinkage
2. Example #2
   a. Normal denim mill brushing and flame singe applied to remove loose surface fibers
   b. Hot water rinse (90° C.) for 15 seconds to wet denim fabric for mercerization
   c. Mercerize with heavy caustic concentration (20% active)---steam at 100° C. for 15 seconds to allow caustic to penetrate (20 meters/second)
   d. Two (2) warm water rinses at 80° C. to remove caustic
   e. One rinse at 60° C. with acetic acid to neutralize caustic
   f. One cold water rinses at 30° C. to remove chemical salts
   g. Normal denim skew process applied to control denim torque/twist
   h. Adjust denim width on pin tenter (normally denim pulled one inch wider than introduced)
   i. Normal denim sanforization process applied to control warp shrinkage
3. Example #3
   a. Taken directly from loom
   b. NO wet fabric finish
   c. Skew adjusted dry on finishing tenter frame
   d. Fabric undulation waves ironed flat in short dry sanforizer pass if n needed Lessening the scouring, but processing with the industry standard 1:5 immersion to oxidation ratio as conventional would have resulted in a reduced dye penetration, but this would result in a much lighter color. The industry relies on greater penetration to impart increased amounts of leuco-indigo on a greater surface area of the yarn to achieve the darker, desirable colors of blue. Increasing the oxidation time alone would have allowed for increased fastness, but with industry accepted scouring standards, this would have resulted in a yarn with increased fastness throughout the yarn, but still left the industry with the burden of washing those yarns for extended periods of time with harsh chemicals and stones in an attempt to remove the dye, similar to the accepted method currently. The contributions are dependent on one another to achieve the goal of a denim with a sufficiently dark blue color with an optimal yarn penetration, while retaining a bright white core. The optimal yarn dye penetration is understood to those skilled in the art of washing is a dye penetration that affords a laundry to impart the least amount of water and chemicals to the fabric in order to consistently reveal what is generically referred to as a "salt and pepper" effect where the jeans have a consistently randomized dark blue/light blue/white effect that the human eye has determined has retail appeal.

Surprisingly, the dramatic change in the ratio of immersion time to oxidation time along with changing other parameters, produced ring dyed warp yarn having a white core that comprised about 65% to 80% of the cross-sectional area of the ring dyed warp yarn for Example #1 as shown in FIG. 2. This result is most unusual since the white core cross sectional area for conventional ring dyed warp yarn is much less, as shown in FIG. 3. The material and processing variables for Example #1 utilizing the methods of the present invention shown in Table 1 and are embodiments of this invention. Another embodiment of the invention is a denim fabric or garment composed of ring dyed warp yarn having a circular "white" core that comprises about 65% to 80% of the cross-sectional area of the ring dyed warp yarn as shown in FIG. 2. The "white" core referred to in this patent application refers to an interior portion of the material that is either un-dyed, or less dyed than the outer highly dyed portion. Comparison of the standard white core shown in FIG. 3 with the white core generated from methods in this invention shown in FIG. 2 is quite telling. FIG. 2 shows the increase in cross sectional area of the white core of the dyed warp yarn. FIG. 2 shows that the outer surface of the yarn is completely dyed blue, that that there is a round boundary area between the dyed portion and an un-dyed portion or a less dyed portion that looks more white than blue that is, the color of the core referred to herein as the white core is closer to white on the CIE chromaticity scale than it is to blue. In addition, FIG. 2 shows a more circular or uniform white core than that in the standard for FIG. 3 and is another embodiment of this invention. It can be seen that the white inner core of FIG. 2, while it may have some areas that are slightly died, are closer to white than they are to blue. In contrast, in FIG. 3, more of the core is blue. In addition, the white core in FIG. 2 has a regular shape, which is a geometrically similar shape to the shape of the outside of the yarn, while the FIG. 3 core has a shape that is not geometrically similar to the white core of the yarn. The term geometrically similar is used herein to refer to the shape of the perimeter of the core being the same kind of shape, as the outer shape of the yarn, and the thickness of the dyed portion being constant all the way around the yarn, e.g. within 25%. For example, if/when the yarn is circular in outer cross section, the core is also mostly circular. If/when the yarn is cylindrical in outer cross section, the core is also mostly cylindrical. The term "substantially circular" is used herein to denote a yarn that is circular or oval that is a distorted circle.

Another measure is that the inside portion of the yarn is less than 25% dyed, while the outer ring of the yarn is more than 75% dyed.

However measured, this creates a dyed ring around the outside perimeter of the yarn that has a thickness that is constant within 25%.

Preservation of a larger percentage of white core in the ring dyeing process of yarn compared to conventional methods also results in improved properties for garments made from such yarn, including: 1) increased effectiveness of dry processing (e.g., hand sanding, laser treatment, bleaching sprays and hand rubs, ozone, and many other treatments on dry garments); 2) more efficient garment washes; and 3) a wider range of garment color and contrast effects possible. In addition, these methods for Example #1 may result in approximately 15-20% savings in water, chemical, and/or energy which supports sustainability program goals of many labels to merchandise to "green" consumers. Most importantly significant time savings could be realized compared to conventional methods. Such time savings could have a dramatic impact on denim jean manufacturing costs. Dry process savings would also exist from this unique concept because laser abrasion cycle time would increase and hand sanding operations would improve since it would be easier to abrade the denim with an enhanced white core. Denim mill costs to manufacture the product would decrease as well.

The methods to increase the cross sectional area of the white core as well as generating a more circular shape of the white core, while maintaining the appropriate fastness or dye penetration is a critical embodiment. The inventors believe that the optimum ring dye product would be one with just enough dye penetration to obtain the desired color along with a maximum white core area to allow for easy wash down when the "salt and pepper" characteristic associated with the stone/enzyme wash look is achieved. The inventor further realized that an irregular shaped white core would be more difficult to wash down with any consistency versus a circular or oval shaped white core, which would provide more consistency throughout the fabric, for the stones and chemicals would only have to attack a small, consistent sized ring versus wildly varied levels of dye penetration into the core if it is irregular shaped. So in addition to being an optimum balance between dye penetration and white core area, the inventors believe that an optimum white core would have a more circular shape with less jaggedness than seen in conventional denim fabrics. Lessening this jaggedness of dyed areas in the perimeter relatively to the inner core is one embodiment. This characteristic is important, as the jaggedness associated with traditional dyeing methods results in a less predictable finish through the wet and dry processing of garments. The amount of chemical or abrasion required to reveal the white core is randomized when dealing with jaggedness, resulting in many more goods denied for failing visual inspection. In one embodiment, the surface of the dyed portion which defines a boundary of the edge of the white core is smooth to within 20%. FIG. 4 shows a schematic of the optimized white core configuration. Undesirable white core schematics are shown in items 1-3 below and desirable white core schematics are revealed in item 4 below:

1. The upper left schematic which shows an irregular non uniform white core with a somewhat jagged shape. When cores lack uniformity, washing produces irregular results from one garment to another, or even within the scope of a single garment, resulting in discarded goods, furthering environmental and financial burdens 2. The upper right schematic which shows too excessive dye penetration and too small white core. Excessive dye penetration, while giving greater consistency to the process, results in longer wash cycle times, increased usage of waters and chemicals to reveal the buried white core
3. The lower left schematic which shows too little dye penetration and too large white core. Too little dye penetration leaves the yarns vulnerable to lower grades of fastness between each successive dye tank, resulting in a lighter overall colored denim which makes the salt and pepper effect previously disclosed unachievable, and creates a high waste rate of dye materials
4. The lower right schematic illustrates an optimum circular white core with the appropriate fastness, which is most desirable, where the white core comprises 65-80% of the cross sectional area of the yarn, and where the white core has a circular or cylindrical outer shape that is geometrically similar to the shape of the outside cross-section of the yarn material.

The methods of this invention apply to 100% cotton and others such as cotton/spandex, cotton/tencel/spandex, and cotton/polyester/spandex warp yarn that is vat-dyed (utilizing pure indigo or indigo and sulfur dyestuff additive layers). The methods of this invention also inhibit dye penetration and support a more ideal, uniform shape of white core.

The material and processing variables for Example #2 of utilizing the methods of the present invention are shown in Table 1 and are embodiments of this invention. Another embodiment of the invention is a denim fabric or garment composed of ring dyed warp yarn having a circular white core that comprises about 80% to 85% of the center of the cross-sectional area of the ring dyed warp yarn as shown in FIG. 5 for Example #2. Comparison of the standard white core shown in FIG. 3 with the white core generated from methods in this invention shown in FIG. 5 shows the increase in cross sectional area of the dyed warp yarn. In addition, FIG. 5 shows a more circular or uniform white core than that in the standard for FIG. 3. These fabrics are better suited than conventional fabrics for new laser and ozone color reduction methods. In addition, these methods for Example #2 may result in approximately 20-25% savings in water, chemical, and/or energy which supports sustainability program goals of many labels to merchandise to "green" consumers. Most importantly significant time savings could be realized compared to conventional methods. Such time savings could have a dramatic impact on denim jean manufacturing costs, reducing the size of the finishing facilities, their energy requirements, in addition to greater machine throughput The material and processing variables for Example #3 of utilizing the methods of the present invention are shown in Table 1 and are embodiments of this invention. Yet another embodiment of the invention is a denim fabric or garment composed of ring dyed warp yarn having a circular white core that comprises about 85% to 90% of the cross-sectional area of the ring dyed warp yarn as shown in FIG. 6 for Example #3. Comparison of the standard white core shown in FIG. 3 with the white core generated from methods in this invention shown in FIG. 6 is very striking. FIG. 6 shows the significant increase in cross sectional area of the dyed warp yarn. In addition, FIG. 6 shows a more circular or uniform white core than that in the standard for FIG. 3. These fabrics are better suited than conventional fabrics for new laser and ozone color reduction methods. In addition, these methods for Example #3 may result in approximately 30-40% savings in water, chemical, and/or energy which supports sustainability program goals of many labels to merchandise and market to environmentally conscious consumers.

Most importantly significant time savings could be realized compared to conventional methods. Results of initial washing trials revealed a reduction in chemicals, water, energy and/or time from use of such a fabric with an optimized white core manufactured from methods of this invention and represent an embodiment. One major denim company estimated that they could save up to 40% in washing costs using denim fabric with the unique characteristics made from methods of this invention.

For reasons previously disclosed, the uniformity and preservation of a larger percentage of white core revealed through our invented methods improves the process of ring dyeing yarn compared to conventional methods. This results in considerable reductions in denim garment washing costs. Even further, and of great economic significance, the throughput of the washing equipment will be significantly increased and in some cases doubled from utilizing the methods of this invention. Throughput increases of this magnitude would have an unprecedented and most favorable cost impact on the denim industry. Further, denim mill water and chemical savings would be realized from using the methods of this invention in comparison to conventional practices.

Dyeing denim, yarn twist, yarn composition, weaving, and finishing denim is all mill oriented. Washing garments after construction is considered wet processing. There is another stage known as dry processing which typically occurs between the mill and wet processing. Garments are cut from their denim rolls into patterns, which are then sewn. After sewing, these garments are often subjected to prewash distressing through a variety of techniques. Areas of the garment may be purposely worn to replicate the natural or unnatural process of a garment involved with heavy labor. Garments may be worn with the application of sandpaper, subjecting the garment to laser light to remove indigo, the spraying of a powerful oxidizer such as potassium permanganate, or even using high pressure air and various particulate or medium such as sand to spottily remove indigo in areas, creating the "worn look." Each one of these dry processes, much like the wet processes, require an amount of energy necessary to remove varying amounts of indigo to lighten or remove the coloring to create shade variances. For this reason, implementation of the embodiments of this invention would have a significant impact on both the quality and costs associated with the dry processing of denim dyed through the realized optimizations disclosed herein. Reducing dye penetration would require less laser energy for dye removal, fewer strokes or less pressure with sandpaper, or less Potassium Permanganate to bleach the color, each resulting in both a cost savings for the dry finishing stage, as well as retaining higher yarn integrity from the reduction of physical and chemical stressors involved with dry processing. One embodiment is the ability to eliminate Potassium Permanganate spray of by using denim fabric produced from methods of this invention. Experiments have shown that the whiteness of the abrasion typically achieved with Potassium Permanganate can be matched by washing denim fabric with the improved white core properties disclosed in this invention One embodiment is the change in the ratio of immersion time to oxidation time of about 1:10, e.g., between 1:6 and 1:18, but preferably 1:10. As there is no significant realized drawbacks to increasing oxidation times past this specification, the upper limits of the specified ratios are references to optimal oxidation times, where further exposure realizes little to no benefit. After the final oxidation, the yarn is dried in a dryer to prevent further oxidation. Another embodiment is the denim fabric with a white core comprising 65% to 90% of the cross-sectional area of the ring dyed warp yarn with the remainder being the indigo dyed warp yarn. Yet another embodiment is the reduction in wash down when garments stone/enzyme washed from fabric produced from methods of this invention. Another embodiment is the subsequent reduction in stone/enzyme washing costs and time with use of the denim fabric made from methods of this invention. Another embodiment is the reduction in denim mill chemical and water costs to produce the fabric.

Test Results

Table I summarizes the results of several trials and illustrates the major differences in the yarn, dye and denim mill processing parameters amongst the aforementioned three examples produced from this invention versus a standard denim fabric. Significant differences exist between the standard ring dye and denim mill process parameters and those disclosed in this invention that represent embodiments of this invention. The major differences in the key process parameters between conventional ring dye and standard or conventional denim mill practices and methods of this invention are revealed below and represent embodiments of this invention:

(1). The weft yarn is typically not conditioned in the standard but can be treated in an autoclave at 65% humidity for the methods of this invention.

(2). Full or partial scouring is applied in conventional yarn dyeing processes by dipping the yarns in a caustic soda bath at high temperatures for the standard to remove bubbles, waxes, oils and other foreign particles from the yarn interior. However, the methods of this invention goes against this common practice by either limiting scouring or eliminating scouring altogether which is a means to achieve a more circular core shape as well as limit dye penetration. If limited scouring is used, the inventor discovered, quite ironically, that the use of cheaper chemicals in the scouring bath do not scour as well as the use of the traditionally more expensive chemicals and this is actually a good result. The cheaper chemicals leave some of the waxes and oils on the yarn which inhibits indigo dye penetration and is an embodiment of this invention.

(3). Full or partial saponification is used in the standard to remove yarn impurities; whereas, low saponification is preferred in the methods of this invention to retain the impurities.

(4). Leuco reduction is quick (excess Hydro) before sky for the standard. The methods of this invention employ short reduction (low Hydro) before sky.

(5). The ratio of time the warp yarn spends in the immersion tank versus the time spent in oxidation is about 1:5 for the standard. A key embodiment in this invention is the significant reduction in this ratio from about 1:5 to about 1:6 to 1:18.

(6). Traditionally the denim mills use pre-reduced indigo solutions in the immersion dye bath. These are solubilized solutions that promote indigo dye penetration on the warp yarn. The inventor found that, quite ironically, the use of inexpensive non-reduced indigo cakes or powdered indigo which are not fully solubilized and thus don't stick to the yarn as well limit dye penetration and is preferred depending upon the other variables.

(7). Standard ring dye methods use an Indigo concentration in the dye bath of 3.0~5.0 g/L. However, the inventor found that reducing the Indigo concentration to about 1.0 to about 3.0 g/L limits indigo dye penetration into the warp yarn and may be beneficial depending upon the other process variables.

(8). The pH of the Indigo dye batch is typically maintained at a range of from about 11.5 to 13.5 for standard processes to increase dye penetration. But part of this invention is to optimize the white core of the dyed warp yarn with the correct amount of dye penetration. Too little dye penetration and the garment will wash down so much that the desired color cannot be obtained and the "salt and pepper" effect will be lost. Too much dye penetration and the garment will take too long to wash down to achieve the desired color. However, it was found that if pH is maintained at low preferred range of about 10.8-12 pH with caustic soda, good dye penetration levels between these two conditions may be achieved.

(9). Hydrosulfite levels in the standard ring dye baths are typically high ranging from 1 to 2 g/L compared to low hydrosulfite levels of about 1 g/L preferred in the methods of this invention.

(10). Standard ring dye baths temperatures are high to promote dye penetration into the yarn interior. The methods of this invention prefer low dye bath temperatures to limit dye penetration.

(11). Standard ring dye methods can employ multiple water rinses but methods of this invention prefer only one water rinse to lessen dye re-deposition.

(12). Caustic fabric mercerization crystallizes yarns to drive indigo and/or sulfur "bloom" to the surface, adds sheen, desizes and promotes consistency. Standard denim fabric is often not mercerized; whereas, two of the Examples in this invention used mercerization.

(13). Standard methods usually use corn or rice starch for production; whereas, methods of this invention prefer potato starch but can employ corn or rice starch.

(14). Normal finishing processes with water and Polyvinyl alcohols (PVA) are used for the standard finishing. The methods of this invention prefer not to use Polyvinyl alcohols (PVA) or high density polyethylene (HDPE). Further, water is reduced or eliminated in one embodiment and the complete finishing process is eliminated in another embodiment. The extra water in the finishing process can be avoided to further reduce indigo dye penetration into the core.

(15). Increasing the warp yarn twist ratio from a standard low range of about 3.0 to 4.5 to a high range of about 4.4 to 4.6 actually provides increased yarn density and less surface area for the dye to penetrate and thus contributes to an improved or optimized white core area and is thus preferred in methods of this invention.

(16). The cross sectional area of the white core of the warp yarn in the standard ring dye and denim mill process methods ranges from about 50% to 60%. However, if all or combinations of the variables shown above are employed for methods of this invention, the white core area can be increased from about 75% to over 90%.

(17). For the surface panel effects, these parameters involve minimum fabric finishing ("loom state") denim in which wet steps have been eliminated to emphasize: 1) elevated warp shrinkage (dry iron on sanforizer); 2) positive skew movement (dry pass to control skew range); and 3) no mercerization to drive dye penetration.

One example that creates the surface panel effects includes no finishing and no mercerization whereas another example include both mercerization and finishing. Also, increasing the weft yarn twist to 4.9 to 5.1 as in Example #2 or 5.9 to 6.1 as in Example #3 will also add to the surface panel effect.

The unique properties of fabric made from yarn produced by the methods of the present invention are accomplished by altering some or all of the multiple ring dye and denim processing factors listed above, particularly where some alterations operate counter to conventional thinking and the prior art regarding modern denim mill and ring dyeing applications.

Although Table 1 reveals specific values for some of the important indigo dye and denim mill process and material variables, the inventor conducted numerous other trials and experiments that indicated potential ranges for these variables as shown below:

Ratio of immersion time to oxidation time: From about 1:6 to about 1:18 for slasher dye or rope dye ranges.

Warp yarn multiple twist: From about 3.5 to about 5.5

Weft yarn multiple twist: From about 4.4 to about 6.3

Yarn Scouring: From using less chemicals and lower temperature to totally eliminating the scouring pH of the Indigo Dye Bath: From about 10.8 to 12

Indigo Source: From Partially Reduced Indigo Powder to Indigo "Cakes"

Indigo Concentration: From about 1.0 to 3.5 g/L

Finishing and Mercerization: From limited finishing with small amounts of water to no water in the finishing process and from no mercerization to complete mercerization.

Cross sectional area of white core of warp yarn: From about 55% to about 95%.

Estimated Savings in Garment Washing: From about 5% to about 65%.

Another novel finding in this invention was discovered from examination of the washed fabrics from Example #2 and Example #3 versus Example #1. Fabric made from yarn produced by the methods of the present invention can also include different denim surface panel effects to duplicate vintage looks using modern spinning, dyeing, weaving, and finishing equipment to commercialize for volume applications. Unique mill processing parameters create the different denim surface effects upon exposure to garment wash conditions. FIG. 7 is a photograph of washed denim fabric from Example 1 that shows a rather flat effect. FIG. 8 is a photograph of washed denim fabric from Example 2 and FIG. 9 is a photograph of washed denim fabric from Example 3. FIGS. 8 and 9 illustrate very unusual surface panel effects created from methods of this invention. Comparison of Example #2 and Example #3 with Example #1 in Table 1 reveal that one of the primary differences in parameters between Example 1 and the other two Examples is the weft yarn twist ratio with the highest values in Examples #2 and #3. It is believed that the higher weft yarn twist ratios versus the standard create the novel denim fabric surface panel effects after washing and is an embodiment of the invention. For some of these surface panel effects, the parameters revealed in Table 1 involve minimum fabric finishing ("modified loom state") denim in which wet steps have been eliminated to emphasize: 1) elevated warp shrinkage (dry iron on sanforizer) and 2) positive skew movement (dry pass to control skew range). Fashion-forward appearances are created that differentiate products produced with denim made from yarn produced by the methods of the present invention from other denim products on the store shelf. Furthermore, denim made from yarn produced by the methods of the present invention allow surface panel effects to occur without the need for physical garment manipulations prior to and after garment washing that are: 1) time consuming; 2) costly; 3) not production friendly; and 4) cause repetitive motion injuries in workers. Finally, Romatex determined that their mixture of ingredients in the slashing/sizing box (odd square with four small rollers near the right end of FIG. 1) was unique in the denim industry and resulted in about a 9% addition to the weight of the dyed yarn. One of the blends proved to achieve this result was:

1. 11% concentration of corn starch, which is more durable to removal by water in garment processing and prevents dye migration inward.

2. 0.3% concentration of wax, which imparts flexibility to the "hard" corn starch on dyed warps for weaving.

3. 0.3% concentration of polyvinyl alcohol (PVA), which is a film-former and acts as a "glue" for the corn starch and wax to bond onto the dyed warp.

Although the methods of the present invention have been primarily described in terms of the use of ring dyed warp yarn for use in denim fabric, one of skill in the art will appreciate that the ring dyed warp yarn produced by the methods of the invention may also be used in knit fabrics. Importantly, the inventor has conducted numerous plant trials in various facilities to demonstrate that the methods in this invention that apply to slasher dye processes can also apply to rope dye processes.

Methods for Measuring the Percentage of White Core in the Ring Dyed Yarn

The present invention is directed to improved methods for ring dyeing yarn for use in woven fabric in which a larger percentage of white core is preserved compared to conventional methods. Methods for assessing the percentage of white core in a ring dyed yarn include: 1) visual review of microscopic yarn cross-sections; 2) spectrophotometric readings of surface color depth and cast flare of microscopic yarn cross-sections; and 3) any other quantitative colorimetric method for assessing color differentials within a sample. Other methods include a visual review of unwashed and washed denim surface appearance, spectrophotometric readings of surface color depth and cast flare before and after wash, and microscopic yarn cross-sections.

The present invention is also directed to improved methods for producing denim surface panel effects. Such effects are assessed via a visual review and comparison of unwashed and washed denim surface panels.

Devices for White Core Optimization in Dyeing Yarn

In another embodiment, the present invention also relates to devices for ring dyeing yarn for use in woven fabric in which a larger percentage of white core is preserved compared to conventional methods. In particular embodiments, the devices are configured to provide a range of the ratio of immersion time to oxidation from about 1:6 to about 1:18 for slasher or ring dye ranges during the dyeing process.

FIG. 1 shows a diagram of a conventional slasher continuous dyeing machine in which the oxidation and immersion dye box steps are labeled. As described elsewhere herein, yarn 100 is held between idlers 105 as it travels along a path. The path causes the yarn to travel through immersion dye boxes such as 110, which is filled with dye. This allows the leuco-indigo dye in the box 110 to paint an outer layer of color onto the yarn. This yarn is held between idlers 111, 112, 112 in the dye box 110, for a time dependent on the speed of the yarn along the path. The yarn then proceeds on idlers 115, out of the box 110, into a "skying" or oxidation segment where the yarn is held between idlers over the box, and the leuco-indigo is transformed to the oxidized blue indigo with air. The process repeats, by going through another box 130, to another oxidation 140, and continues, to continue to build color yield on the perimeter of the yarn.

In particular embodiments of the invention, devices are configured such that a conventional slasher continuous dyeing machine as shown in FIG. 1 is configured such that the amount of time that yarn spends in each oxidation step is 6-18 times the amount of time that yarn spends in each immersion dye box step. This may be achieved, for example, by increasing the distance between rollers shown in the oxidation steps of FIG. 1, by increasing the numbers of rollers shown in the oxidation steps of FIG. 1, or any other modification that results in the desired range of the ratio of immersion time to oxidation in the dyeing process. All such machine modifications are embodiments.

In other embodiments of the invention, conventional devices may be modified in such a way that the amount of time that yarn spends in each oxidation step is 6-12 times the amount of time that yarn spends in each immersion dye box step. Conventional devices for ring dyeing yarn for use in woven fabric are described, for example, in PCT Patent App. Pub. No. WO2006013458, U.S. Pat. Nos. 5,337,586; 7,313,935; 7,908,894, and 8,215,138. In order to realize this ratio reduction from 1:5 to 1:10 or so, the throughput of the rope dyeing process may need to be reduced which is another embodiment of this invention.

General Definitions

Cotton yarn generally refers to a double or multi-stranded filament made by twisting or otherwise bonding cotton staple fibers together to make a cohesive thread. Twisting fibers into yarn is, of course, the process called spinning.

Cotton staple fibers can be spun into yarn in the form of single ply or multi-plied yarns. Cotton staple fibers which form such yarns typically range from about 1.0 to about 3.0 denier per filament (dpf) and have a staple length range of from about 0.5 to 8.0 cm.

It is well known that cotton fibers can be combined with other fiber types when fashioned and used in the form of yarns. However, the best pre-treating, dyeing and fabric formation results obtained using the methods described herein are achieved when the yarns used contain no fibers other than cotton. Accordingly, yarns which are 100% cotton are preferred for use in the present method.

Cotton yarn which has been, or is to eventually be, incorporated into denim fabric in the warp direction is referred to herein as "warp yarn" Of "cotton warp yarn".

Conversely, cotton yarn which has been, or is to eventually be, incorporated into denim fabric in the weft (or fill) direction is referred to herein as "weft yarn" or "cotton weft yarn".

Cotton warp and weft yarns can be fashioned into cotton denim fabrics in accordance with the methods herein by any conventional technique known for the preparation of such denim fabrics.

Weaving is a common method for making cotton yarn into cotton denim fabrics. The woven cotton denim fabrics which can be indigo dyed in accordance with the dyeing methods described hereinafter include, for example, those of a basic weave, satin weave, twill weave, ripstop weave, or basket weave. Denim fabrics are most commonly of the twill weave type.

Cotton yarns can also be knitted to provide a variety of denim knit fabric types prior to being dyed in accordance with the dyeing method herein. Denim knit cotton fabrics will generally be of the warp type, including tricot knits or raschel knits.

Fastness is the ability of a material or dye to maintain its color without fading or washing away.

Indigo has been used to dye fabric with "indigo blue" since before recorded history. Indigo has been used in India to dye fabric for at least 4,000 years by methods which are practically identical to the methods employed today. Indigo was introduced in Europe in large quantities by the Dutch East India Company in the early 17th century.

Indigo ($C_{16}H_{10}N_2O_2$) is the true coloring matter of indigo dye which is generically known as Vat Blue 1. When pure, indigo forms a dark, rich blue powder or bronzy blue-colored needle crystals. The most important reaction of indigo is its reaction with reducing agents. When subjected to a reducing agent in the presence of alkali, indigo combines with two atoms of hydrogen and is reduced to a colorless body, known as indigo-white or the leuco form, which is insoluble in water, but dissolves in alkali, with a yellow color. The leuco form of the indigo dye deposited onto cotton yarn is generally subjected to a "skying" process wherein the lueco form of the dye is oxidized with air to a blue indigo color.

Mercerization is a process that makes cotton yarn take dye better and increases its luster. The cotton is treated with a caustic soda such as Sodium Hydroxide to increase the fiber's luster and increase its affinity for dye. In addition the cotton fibers are typically stronger after mercerization.

The aqueous dyeing liquor can optionally contain various fabric treating adjuvants besides the indigo dyestuff material. Such adjuvants can include, for example, optical brighteners, fabric softeners, antistatic agents, antibacterial agents, anti-wrinkling agents, ironing aids, flame-retardants, enzymes, uv stabilizers, anti-foaming agents, perfumes, and the like.

The denim fabric can, of course, be fashioned into end use products such as garments, apparel, upholstery, linens, etc. prior to being contacted with the aqueous dispersion of the indigo dyestuff material and dyed. For garments, industrial garment washing machines may be used for dyeing. Optional dyeing application methods include manual processes such as spraying or manual wet add-on techniques.

Other techniques can also be used to produce even more superior results:

A. Increase warp yarn twist multiple to 5.0 and 5.3 before warp dyeing to further limit surface area and tighten the yarn fiber cable effect.

B. Increase weft/filling twist multiple to 6.5 for increased panel crackle. This will likely elevate warp twill line that may increase wash abrasion contrast.

C. White core technology lends many benefits to the textile mill through cost savings in the reduction of chemical consumption, energy savings with lower temperatures in scouring and oxidation stages, and does so while improving the aesthetics and quality of the product.

D. The manufacturers of garments save significant overhead and chemical consumption during the wet processing stage with the white core technology through massively decreased wash-down times. This frees up large, costly washing machines, and making great strides in reducing environmental impact.

E. Still, the greatest impact white core technology offers the textile industry may come at the dry processing stage. Dry processing traditionally involves heavy implementation of hand sanding operations. Operators labor to abrade garments manually while loosely following often simplified versions of a designer's original pattern. Operator fatigue, repetitive injuries, high employee turnover, and the necessity of potassium permanganate spray make hand sanding an expensive necessity.

F. White core technology, paired with RevoLaze's patented laser technology, will change the manufacturing landscape for the better. For decades, lasers, just as laborers, have struggled with traditional dyeing techniques of textile goods. Excessive dye penetration at the mill requires either excessive labor or laser energy to remove the necessary indigo dye to reveal the white core. Often times, garments would receive laser treatment but still require PP spray to lessen the effect of the irregularly shaped core and the color retention involved with it. PP spray has been known for decades to be a health hazard to the long term lung health of the operators required to spray and handle it.

G. With white core technology, lasers can much more effectively and precisely remove dye from textiles. This increase in efficacy has the potential to eliminate the dependence on PP spray for selective bleaching and also greatly improves the aesthetics of the achievable patterns. A greater reliance on laser will result in designers realizing their designs, patterns, logos, and textures and improve the overall marketability of denim on the whole. Not since the original introduction of laser to the denim manufacturing world has there been such an exciting opportunity for laborer safety, cost savings, liberation in design, and an improved product desirability.

H. By preserving a larger percentage of the white core and generating a more circular shape of the white core, it allows improved laser quality, consistency and throughput. In the case of Examples #1 and #2, there is less starch and that also allows improved laser quality because it can more easily penetrate into the fabric. The larger percentage of the white core allows the laser to penetrate the core faster and therefore less laser intensity is needed. By having a more circular shape of the white core, when the laser penetrates the core, it will have a much more consistent result throughout the core compared to the standard white core which is more jagged in shape.

I. A major benefit of this invention is that when using the laser technology, it can replace potassium permanganate spray (PP spray), which is a very hazardous chemical. PP spray is used to add brightness or whiteness to the abraded area. Laser etching or hand sanding alone cannot achieve the brightness necessary on normal denim fabric. PP spray also requires additional water and chemicals for its removal. However, by using methods in this invention, it is now possible to replicate the look of PP spray by laser alone. By laser etching on the rigid fabric, it can achieve a similar brightness or whiteness compared to PP spray. For optimal results, laser etching should occur on the washed garment to properly replace PP spray. However, both methods can be used. These results are possible because once the laser penetrates into the core, a brightness or whiteness automatically appears, which has a similar look of PP spray. An embodiment therefore is the improvement of the laser to penetrate the core with the white core technology compared to conventional denim fabric.

J. A critical embodiment is to couple RevoLaze's LightLaze software (patent pending) with this white core technology invention to give optimal laser etching and product performance results. Since LightLaze enhances the laser file, more highs and lows within the file will be visible on this denim compared to normal denim fabric and the resolution will be subsequently improved. The details and quality of design will improve on this unique fabric, along with increased laser throughput. Filters that will be incorporated into the LightLaze software will replace hand sand touch ups and give much more detailed textures and hand sand looks with the white core fabric compared to normal denim fabric.

Following long-standing patent law convention, the terms "a," "an," and "the" refer to "one or more" when used in this application, including the claims. Thus, for example, reference to "an object" includes a plurality of subjects, unless the context clearly is to the contrary (e.g., a plurality of objects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

TABLE 1

| | Standard | Example #1 | Example #2 | Example #3 |
|---|---|---|---|---|
| White Core | 50%-60% | 75%-80% | 80%-85% | 85%-90% |
| Warp Yarn Twist | 3.0-4.5 | 3.9-4.2 | 4.4-4.6 | 4.4-4.6 |

TABLE 1-continued

| | Standard | Example #1 | Example #2 | Example #3 |
|---|---|---|---|---|
| Weft Yarn Twist | | 4.4-0.6 | 4.9-5.1 | 5.9-6.1 |
| Yarn Conditioning | None | Weft in autoclave @ 65% humidity to ensure consistent weaving | Weft in autoclave @ 65% humidity to ensure consistent weaving | Weft In autoclave @ 65% humidity to ensure consistent weaving |
| Scouring | Full or Partial Scouring | Limited Scouring | Limited Scouring | Limited Scouring |
| Saponification | Full OR partial to remove yarn impurities | Low saponification with Medium Temp (80%) - bubbles, waxes, oils remain) | Low saponification with Medium Temp (80%) - bubbles, waxes, oils remain) | Low saponification with Medium Temp (80%) - bubbles, waxes, oils remain) |
| Dye Penetration | Uneven AND deep | Even AND shallow | Even AND shallow | Even AND shallow |
| Leuco Reduction | Quick Reduction (Excess Hydro) before sky | Short Reduction (Low Hydro) before Sky | Short Reduction (Low Hydro) before Sky | Short Reduction (Low Hydro) before Sky |
| Ratio of Immersion to Oxidation | 1 to 5 | 1 to 10 | 1 to 10 | 1 to 10 |
| Indigo Paste | Pre-Reduced to 20% | NOT Pre-reduced Indio Powder | NOT Pre-reduced Indio Powder | NOT Pre-reduced Indio Powder |
| Indigo Concentration | High (3.0-5.0 g/L) | Low (2.5-3.0 g/L) | Low (2.5-3.0 g/L) | Low (2.5-3.0 g/L) |
| pH Range | 11.5-13.5 (High and Wide) | 11.6-11.8 (Low) | 11.6-11.8 (Low) | 11.6-11.8 (Low) |
| Alkalinity | Caustic (50%) @ 5.0 g/L | Caustic (50%) @ 5.5 g/L to support reduction (low mV) | Caustic (50%) @ 5.5 g/L to support reduction (low mV) | Caustic (50%) @ 5.5 g/L to support reduction (low mV) |
| Hydrosulfite Levels | High @ 1.0-2.0 g/L | Low @ 1.0 g/L | Low @ 1.0 g/L | Low @1.0 g/L |
| Dye Box Temperatures | High to promote penetration | Low to prevent penetration | Low to prevent penetration | |
| Nip Pressures | High Squeeze to drive dyes to yarn interior | High Squeeze (4.5-6.5 bar) to promote surface drying | High Squeeze (4.5-6.5 bar) to promote surface drying | High Squeeze (4.5-6.5 bar) to promote surface drying |
| Rinsing Process | | Only one water rinse to remove dye redeposition | Only one water rinse to remove dye redeposition | Only one water rinse to remove dye redeposition |
| Fabric Mercerization | None | Yes | Yes | None |
| Starch Used For Slashing | Corn or Rice | Potato | Potato (Smooth Panel) OR Corn or Rice (Uneven Panel) | Potato (Smooth Panel) OR Corn or Rice (Uneven Panel) |
| Core Spun Spandex/Elostane | Draw Blended OR dual T-400 Filament Core - Poor Adhesion/ NOT Corespun | Core Spun - NOT Blended or dual T-400 Filament Core | Core Spun - NOT Blended or dual T-400 Filament Core | Core Spun - NOT Blended or dual T-400 Filament Core |
| Finshing - Poly Vinyl Alcohols | Yes | NO Poly Vinyl Alcohols - FLAT | NO Poly Vinyl Alcohols - FLAT | |
| Water/Chemical/Energy Savings | N/A | 15-20% | 20-25% | 30%-40% |

What is claimed is:

1. A cotton yarn material formed of a circular cross section material, with a cross sectional area of a white core in the yarn being at least 65% of the cross sectional area of the yarn, where the white core has a color that is closer to white on a Commission Internationale de l'Elcairage, herein, CIE chromaticity scale than it is to blue.

2. The material as in claim 1, wherein a thickness of a dyed portion around an edge of the yarn, which defines a boundary of the white core, is constant within 25%.

3. The material as in claim 1, wherein the yarn has a twist multiple ranging from 3.5 to 6.3.

4. A denim material formed by dyed warp yarns woven with other filing yarn including weft yarn, wherein the warp yarn Includes a cotton-containing yarn material formed of a circular cross section material, with a cross sectional area of a white core in the yarn being at least 65% of the cross sectional area of the yarn where the white core has a color that is closer to white on a Commission Internationale de l'Elcairage, herein CIE chromaticity scale than it is to blue.

5. The material as in claim 4 where the dyed warp yarns have a twist multiple ranging from 4.0 to 5.0.

6. The material as in claim 4 where the filing yarns have a twist multiple ranging from 4.5 to 6.1.

7. The garment made from the material in claim 4 which when dry processed achieves the abrasion intensity associated with Potassium Permanganate without the use of Potassium Permanganate.

8. The garment made from the material in claim 4 which when dry processed achieves 10-50% improvement in laser abrading cycle time.

9. The garment made from the material in claim 4 which reduces washing costs from 10-60% for the same wash color obtained from conventional stone/enzyme washing processes.

10. A denim material formed by dyed warp yarns woven with other filing yard, wherein the warp yarn having a dyed ring around an outside perimeter of the yarn, where the dyed ring is constant in thickness within 25% around the outside perimeter, where yarn forming the material is formed by a process comprising the steps of:

Exposing a yarn material to a dye bath; and removing the yarn from the dye bath and exposing the soluble leuco-indigo dye to air to oxidize effectively fixing the dye to the yarn that has passed through the dye bath;

Where there is a ratio of immersion time to oxidation time which is between 1:6 and 1:18.

11. The material as in claim 10, wherein the exposing creates a cotton yarn material formed of a circular cross section material, with a cross sectional area of a white core in the yarn being at least 65% of the cross sectional area of the yarn, where the white core has a color that is closer to white on a Commission Internationale de l'Elcairage, herein CIE chromaticity scale than it is to blue.

12. The material as in claim 10, further comprising, prior to said exposing, Scouring only an outside perimeter of the yarn prior to dyeing without cleaning an entirety of the yarn;

And after said scouring, dyeing the yarn whose outer perimeter has been scoured.

13. The material of claim 12, wherein the outer 15-25% of the yarn's cross sectional area is scoured and the inner 75-85% of the yarn is not scored.

14. The material as in claim 12, wherein said dyeing comprises Creating a dye bath by using indigo solid material that is only partially dispersed, and not fully dispersed in the dye bath, and Passing a yarn through the dye bath with the indigo solid material that is not fully dispersed in the dye bath to dye the yarn.

15. The material as in claim 14, wherein the dye bath includes indigo powder that is not fully dispersed in the dye bath.

16. The material as in claim 14, wherein the dye bath includes indigo cake material that is not fully dispersed in the dye bath.

17. The material as in claim 14, further comprising, prior to dyeing,

Scouring only an outside perimeter of the yarn prior to dyeing without cleaning an entirety of the yarn;

And dyeing the yarn whose outer perimeter has been scoured.

18. The material of claim 17, wherein the outer 20% of the yarn's cross sectional area is scoured and the inner 80% is not scoured.

19. The material of claim 17, wherein the outer 15-25% of the yarn's cross sectional area is scoured and the inner 75-85% of the yarn is not scoured.

20. The material of claim 19, wherein said dyeing comprises Creating a dye bath by using indigo solid material that is only partially dispersed, and not fully dispersed in the dye bath, and Passing a yarn through the dye bath with the indigo solid material that is not fully dispersed in the dye bath to dye the yarn.

* * * * *